US006077057A

United States Patent [19]

Hugenroth et al.

[11] Patent Number: 6,077,057

[45] Date of Patent: Jun. 20, 2000

[54] SCROLL COMPRESSOR WITH BACK PRESSURE SEAL PROTECTION DURING REVERSE ROTATION

[75] Inventors: Jason J. Hugenroth; Gene Michael Fields; John R. Williams; Thomas R. Barito, all of Arkadelphia, Ark.

[73] Assignee: Scroll Technologies, Arkadelphia, Ark.

[21] Appl. No.: 08/921,448

[22] Filed: Aug. 29, 1997

[51] Int. Cl.[7] ..... F04C 18/04

[52] U.S. Cl. ..... 418/55.4; 418/55.5; 418/57

[58] Field of Search ..... 418/55.4, 55.5, 418/57

[56] References Cited

U.S. PATENT DOCUMENTS

| | | | |
|---|---|---|---|
| 4,645,437 | 2/1987 | Sakashita et al. | 418/55.5 |
| 4,993,928 | 2/1991 | Fraser, Jr. | 418/55.5 |
| 5,145,345 | 9/1992 | Barito et al. | 418/55.5 |
| 5,588,820 | 12/1996 | Hill et al. | 418/55.5 |
| 5,591,014 | 1/1997 | Wallis et al. | 417/310 |
| 5,607,288 | 3/1997 | Wallis et al. | 417/310 |

*Primary Examiner*—John J. Vrablik
*Attorney, Agent, or Firm*—Howard & Howard

[57] ABSTRACT

A number of scroll compressor designs protect the back chamber seals upon reverse rotation. In the prior art, scroll compressors are sometimes miswired and inadvertent reverse rotation results. In some applications, this has caused the seals to be crushed. The present invention ensures that upon reverse rotation, the pressure within the back chamber is maintained at suction pressure rather than the very low pressure which may be found in the compression chambers. The seals are protected. In one embodiment, a relief is formed at a seal groove to ensure suction pressure does communicate into the back chamber. In other embodiments, a valve controls the pressure in the back chamber. Upon normal operation, the valve allows pressure from the back pressure tap to communicate into the back chamber. During reverse rotation, the valve allows suction pressure to communicate to the back chamber.

25 Claims, 4 Drawing Sheets

SCROLL COMPRESSOR WITH BACK PRESSURE SEAL PROTECTION DURING REVERSE ROTATION

BACKGROUND OF THE INVENTION

This invention relates to a series of embodiments which protect the back chamber seals in a scroll compressor if the scroll compressor is inadvertently run in reverse.

In the prior art, scroll compressors are becoming widely utilized in refrigerant compression applications. There are a number of reasons why scroll compressors are preferred compared to other compressor types, and these reasons have led to their wide adoption. However, scroll compressors do present a number of design challenges.

Scroll compressors have an orbiting scroll moving relative to a fixed scroll to decrease the size of compression chambers and compress entrapped fluid. As fluid is compressed between the scroll wraps, a separating force is generated tending to force the orbiting scroll away from the fixed scroll both axially and radially.

The prior art taps a working pressure compressed fluid to a chamber behind the orbiting scroll to act in opposition to the axial separating force. The back pressure fluid biases the orbiting scroll axially against the fixed scroll. Typically, a pair of seals are placed in grooves on either side of a back pressure tap to seal and define the area of the back chamber. This type arrangement works well to provide a back pressure force in opposition to the separating force from the compressed fluid.

There have been challenges to maintaining the back chamber systems. In particular, scroll compressors have sometimes been inadvertently run in reverse. When this happens, the scroll members quickly generate heat, which is conducted to the seals. Reverse rotation may occur upon set up of the scroll compressor if the electronics are improperly connected. As an example, when a three phase power supply is miswired there may be reverse rotation. Also, a power flicker can cause reverse running in compressors equipped with single phase motors.

The seals expand due to this heat causing the inner seal to seal against the outer diameter wall of the seal groove. The expanded seal then blocks communication of suction pressure from outside the back chamber into the back chamber.

Typically, the back chamber is at a working pressure above suction pressure when the scroll compressor is rotating in the proper direction. However, upon inadvertent reverse rotation, the opposite is true. In fact, the pressure communicating to the back pressure chamber is lower than suction, as the compressor is effectively acting as a vacuum pump.

When the suction pressure is greater than the pressure in the back chamber and the inner seal OD seals against the groove wall, the pressure imbalance crushes the lower lip against the upper lip. This is true since the seals block communication of suction pressure into the back chamber. The imbalance between the very low pressure in the back chamber and the suction pressure has thus led to the seals being crushed, thus preventing the seals from sealing during normal operation.

SUMMARY OF THE INVENTION

This invention discloses a number of scroll compressor embodiments with a back chamber which works as typically designed during normal operation. However, upon reverse rotation, the embodiments are designed to ensure that there will not be a pressure imbalance between the back chamber and suction pressure. The embodiments allow the back chamber to receive suction pressure in a reverse rotation condition.

In a most preferred embodiment, an inner seal groove has a relief portion extending from an outer diameter of the groove. If the inner seal expands due to heat, as described above, the inner seal may block flow of suction gas along the outer diameter of the inner groove. The relief still ensures that suction pressure can communicate past the inner seal, and thus into the back chamber. In this way, the present invention ensures that upon reverse rotation, the seal will not be crushed. Such a relief could also be formed in the seal.

In other embodiments, a valve is exposed to working pressure in the back chamber on one face and suction pressure on an opposed face. During normal operation, the working pressure in the back chamber is greater than suction pressure and thus the valve is biased against the suction pressure tap, closing the tap. Thus, the back chamber is exposed only to working pressure and functions as designed. However, if the compressor is rotated in reverse direction, then the suction pressure is higher than the "working" pressure in the back chamber. In such an instance, the valve is driven off the suction pressure tap seat by the greater pressure allowing pressure equalization between suction and the back chamber. The seals are thus protected.

In other embodiments of the present invention, a valve associated with the orbiting scroll is typically moved to close the back pressure tap. In one embodiment, the valve is formed of a magnetic material biased to close the tap.

In another embodiment the valve is configured such that when a very low pressure is in the hack chamber, the flow around the valve is such that the valve is urged to close the working pressure tap. A worker in the art would recognize that a design having the valve closely received at an outer periphery and with the top of the valve exposed to the working pressure chamber, would achieve this goal. With such a design, when the compressor is rotated in a reverse direction, the valve will be drawn to close the working pressure tap.

In either of these embodiments, upon normal operation the working pressure drives the valve away from the working pressure tap, and the back chamber is exposed to working pressure. However, upon reverse rotation, the valve closes the working pressure tap.

In a final embodiment, a generally C-shaped groove receives a valve which is moveable within the groove. Upon rotation in one direction the valve is driven by inertial and/or frictional forces to an extreme end of the C-shaped groove. At that end the working pressure tap is opened. This valve position is reached when the compressor is rotating in the proper direction. The other end of the C-shaped groove receives the working pressure tap. Should the compressor rotate in the reverse direction, the valve is driven to the other end of the groove to close the working pressure tap.

With any of the embodiments having the working pressure tap closed, suction pressure is then supplied to the back chamber. Thus, the seals will not be destroyed as in the prior art.

These and other features of the present invention can be best understood from the following specification and drawings. The following is a brief description of the drawings.

DETAILED DESCRIPTION OF A PREFERRED EMBODIMENT

Figure 1:
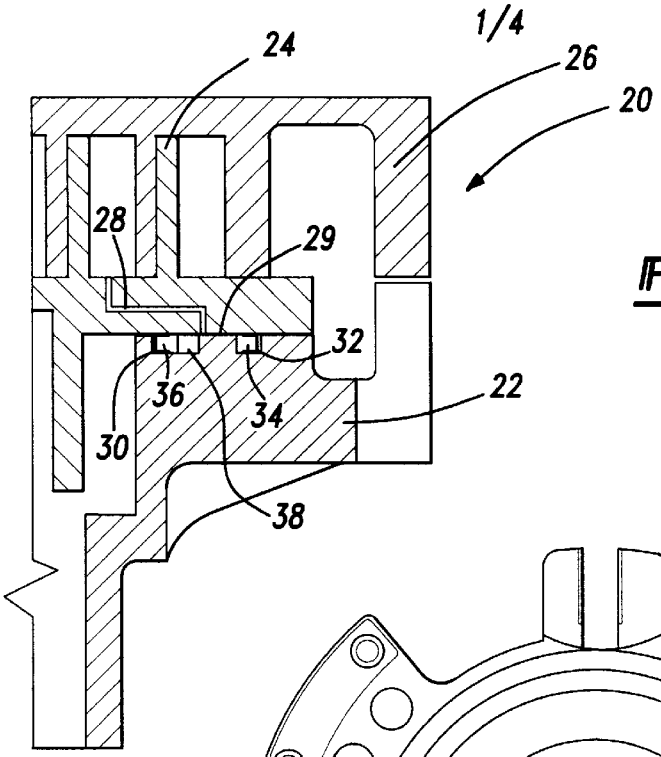
FIG. 1 is a partial cross-sectional view through a first embodiment scroll compressor.

A scroll compressor 20 is shown in FIG. 1 having a crankcase 22 mounting an orbiting scroll member 24. A fixed, or non-orbiting, scroll member 26 has a wrap interfitting with a wrap from the orbiting scroll member 24, as known. A working pressure tap 28 taps a working pressure fluid from compression chambers formed between the orbiting scroll 24 and the fixed scroll 26 into a back chamber 29 between the crankcase 22 and the orbiting scroll 24.

A seal groove 30 is formed at a radially inner location and a second seal groove 32 is formed at a radially outer location. Groove 32 receives a seal 34 and groove 30 receives a seal 36. A semi-circular relief 38 communicates with an outer diameter of groove 30.

Figure 2:
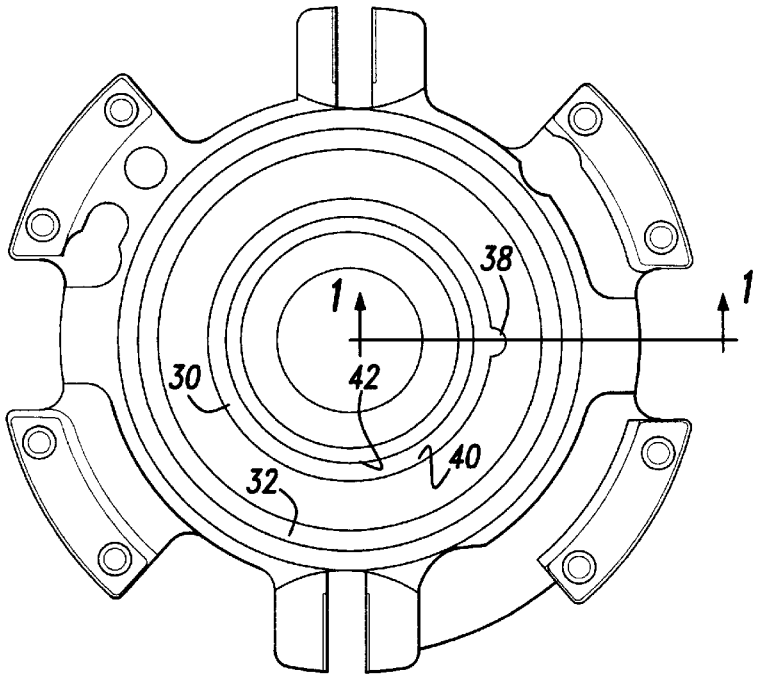
FIG. 2 is an end view of a crank case according to the present invention.

As shown in FIG. 2, groove 30 includes an outer diameter 40 and an inner diameter 42. Relief 38 extends outwardly of outer diameter 40.

Figure 3A:
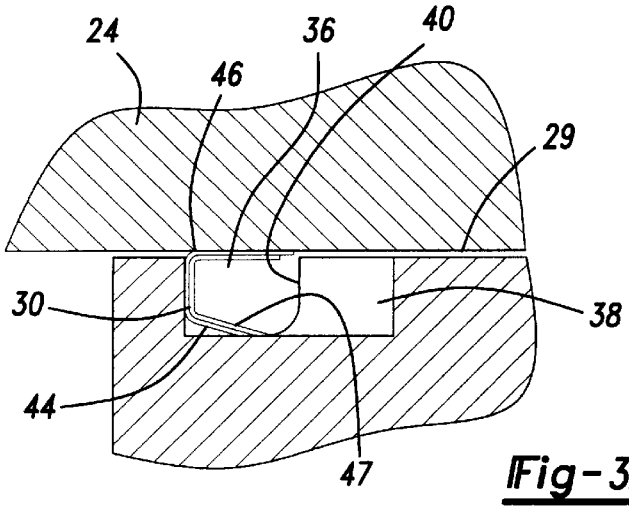
FIG. 3A is a detailed view of the FIG. 1 cross-section.

As shown in FIG. 3A, the seal 36 is of the type being generally C-shaped and including a top lip 46, a lower lip 44 and a working spring 47. This type seal is known in the art.

Figure 3B:
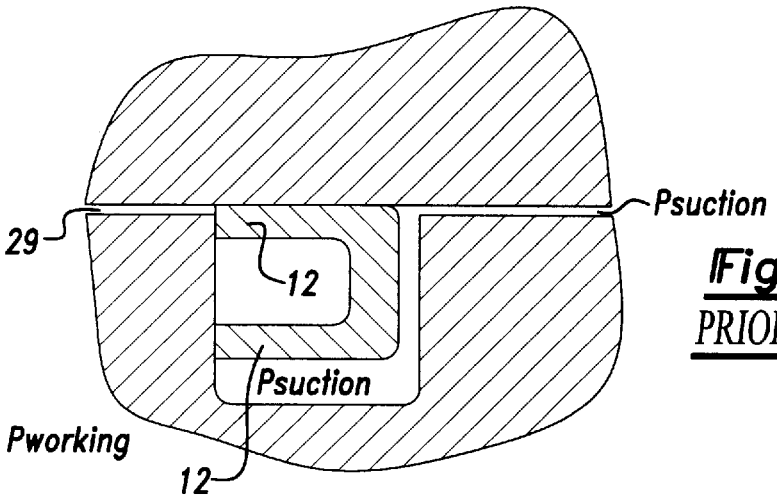
Fig-3B PRIOR ART
FIG. 3B shows the pressure seen by the known back chambers.
Figure 3C:
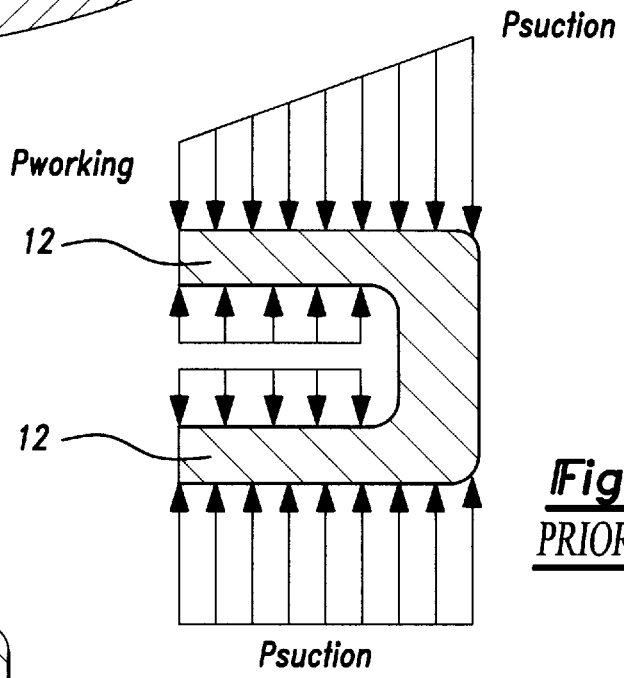
Fig-3C PRIOR ART
FIG. 3C shows the forces on the prior art seals.
Figure 3D:
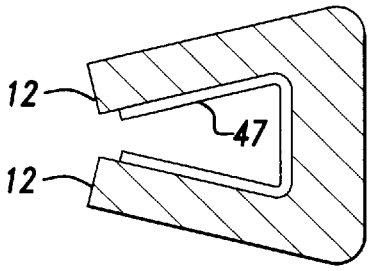
Fig-3D PRIOR ART
FIG. 3D shows a prior art seal which has been crushed. 15

Under normal operation, a relatively high working pressure fluid is found in chamber 29, and thus, is exposed to the area between the lips 44 and 46 and forces the lips away from each other. However, in the prior art, when the compressor runs in a reverse direction, the pressure on the outside, or to the left in FIG. 3A, of the lip 46 is at suction pressure, whereas the pressure to the right of the outer diameter 40 is at a very low pressure. The lips 44 and 46 may expand and seal on outer diameter 40. As can be appreciated from FIG. 3B, when the prior art seal 10 has its seal lips 12 expand, suction fluid cannot leak into back chamber 29. As can be appreciated from FIG. 3C, one lip is then exposed to suction pressure while the other lip is exposed to a range of pressures. The range can be identified as a ramp from the low working pressure in the back chamber 29, to the relatively high suction pressure. This pressure imbalance may crush lips 12, as shown in FIG. 3D, destroying the seal. In some crushed seals, the spring may yield.

With the present invention, suction pressure is able to move beyond the lower lip 44 and into the relief 38. The relief thus ensures that there is not a large pressure imbalance between back chamber 29 and suction pressure upon reverse rotation. Relief 38 is shown to be of the same depth as groove 30. Preferably, the groove is of the same depth or approximately the same depth. It should also be understood that a relief could be formed in the outer seal groove, and preferably at the inner diameter of the outer seal groove.

Figure 3E:
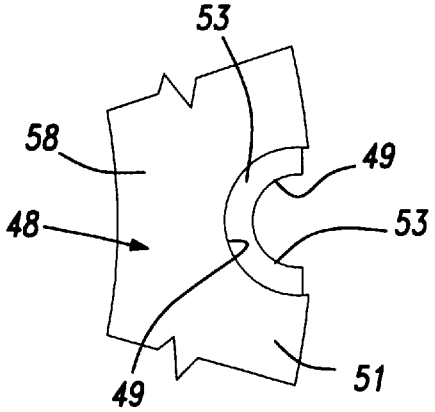
FIG. 3E is a view similar to FIG. 3A but showing a distinct embodiment.

As shown in FIG. 3E, in another embodiment the relief is formed in seal 48 by a scalloped portion 49 formed in the upper lip 51 and/or lower lip 53. The relief serves to communicate suction pressure when there is reverse rotation.

Figure 4:
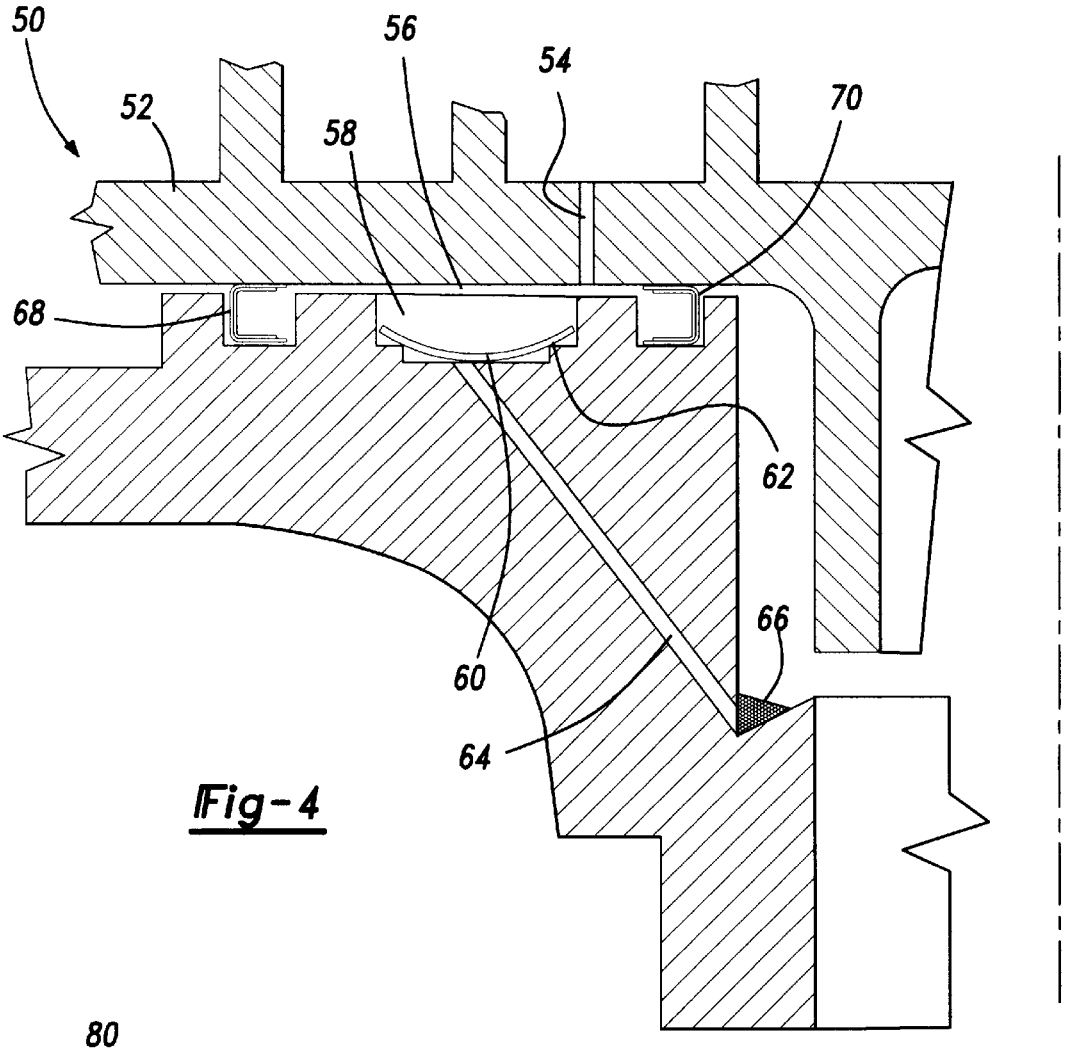
FIG. 4 shows a second embodiment scroll compressor.

FIG. 4 shows an embodiment 50 having an orbiting scroll 52 with a tap 54 leading to a back chamber 56. A valve chamber 58 receives a valve 60 shown seated on a valve seat 62. Valve seat 62 closes off a tap 64 which communicates suction pressure to one side of the valve 60. During normal operation, the pressure in tap 54 is greater than the pressure in tap 64 and valve 60 is forced against the seat 62 closing tap 64. However, upon reverse rotation, valve 60 is forced upwardly such that suction pressure does communicate to the chamber 56. To achieve this function it may be desirable that tap 64 has a greater flow cross-section than tap 54. Valve 60 may be flexible, as shown.

In the embodiment shown in FIG. 4, tap 64 communicates downwardly to an oil reservoir 66. Oil from reservoir 66 can move upwardly through tap 64 such that not only is suction pressure communicated to chamber 56, but oil is also brought into the chamber. This ensures that even during the reverse rotation, oil will be brought into chamber 56, and into the compression chambers through tap 54. Alternatively, a simple tap to suction pressure can extend generally axially from chamber 58, rather than the angled tap 64 leading to an oil reservoir.

Figure 5:
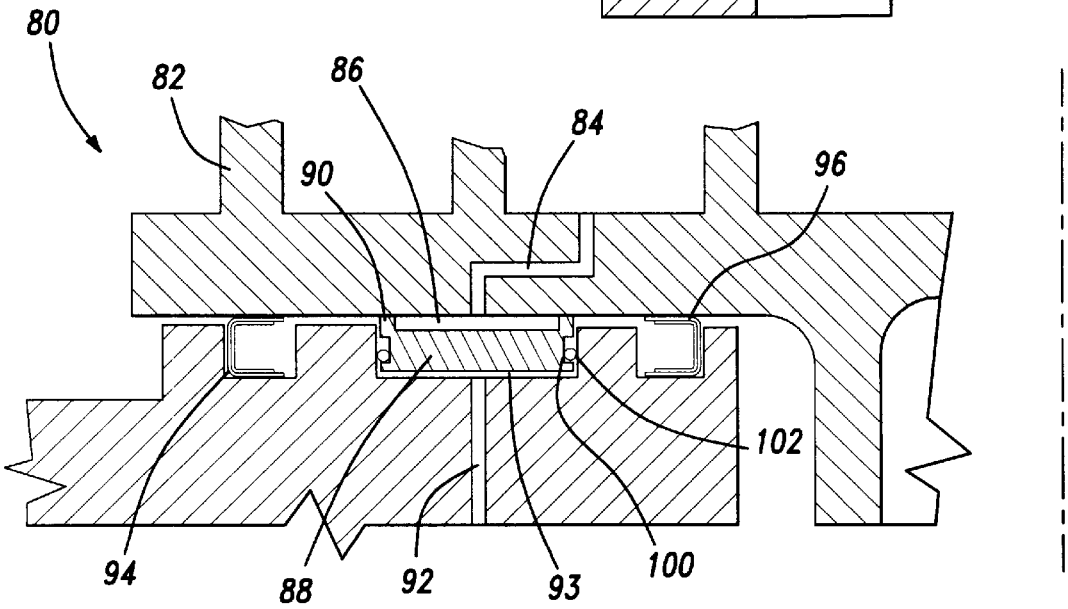
FIG. 5 shows a third embodiment scroll compressor.

FIG. 5 shows a third embodiment 80, wherein the orbiting scroll 82 receives a working pressure tap 84 to tap fluid to a back chamber 86. A valve 88 moves upwardly such that a cylindrical sealing lip 90 abuts a rear face of the orbiting scroll 82 to close off the tap 84 from the back chamber 86 under certain conditions. A suction vent 92 supplies suction pressure to an opposed side 93 of valve 88. Seals 94 and 96 are placed on either side of the tap 84 and valve 88.

Under normal operation the pressure in tap 84 is higher than the pressure in vent 92 and the valve 88 is forced away from tap 84. However, upon reverse rotation the pressure in tap 92 is greater than the pressure in tap 84 and the valve is forced upwardly such that lip 90 seals on the rear face of orbiting scroll 82, and tap 84 is blocked. Preferably, the valve 80 surrounds tap 84 throughout its orbital cycle to keep the tap closed throughout rotation of the orbiting scroll 82. The path of tap 84 during orbiting is easily calculated. During reverse rotation the suction pressure may leak into chamber 86. Although a specific valve is shown other valve configurations can be used.

Figure 6:
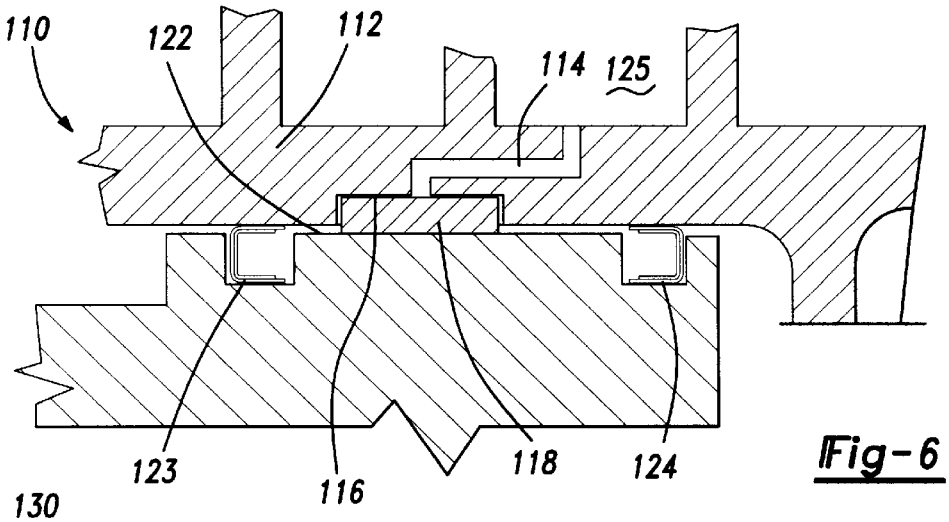
FIG. 6 shows a fourth embodiment scroll compressor.

FIG. 6 shows yet another embodiment 110, wherein the orbiting scroll 112 has a back pressure tap 114 leading to a valve chamber 116 receiving a valve 118. A back chamber 122 is defined between the seals 123 and 124. The valve 118 is constructed such that at least during reverse rotation where there is low pressure at the compression chamber 125, the valve will close tap 114. In one embodiment, the valve 118 is formed of a magnetic material that is attracted to the orbiting scroll 112 such that it will close off the tap 114 unless the pressure in chamber 125 is great enough to overcome the magnetic force. The magnetic force may be relatively low such that it is easily overcome by the working pressure in chamber 125 during normal operation. However, upon reverse rotation, the valve will be closed by the magnetic force, thus blocking the working pressure from reaching the chamber 122. The chamber 122 will thus remain at suction pressure and the seals 123 and 124 are protected.

In a second embodiment, the valve chamber 116 and the valve 118 are constructed so that when a very low pressure is found in chamber 125, the flow around the valve 118 is such that there is a greater flow area above the valve 118 than to the sides of the valve 118. With such a design, the very low pressure will cause the valve 118 to be drawn to close the tap 114. Upon normal operation working pressure easily drives valve 118 away from tap 114.

Either embodiment thus protects the seals by blocking the low pressure from chamber 125 from reaching the chamber 122 upon reverse rotation. In this way, the chamber 122 is maintained at suction pressure during any reverse rotation.

Figure 7:
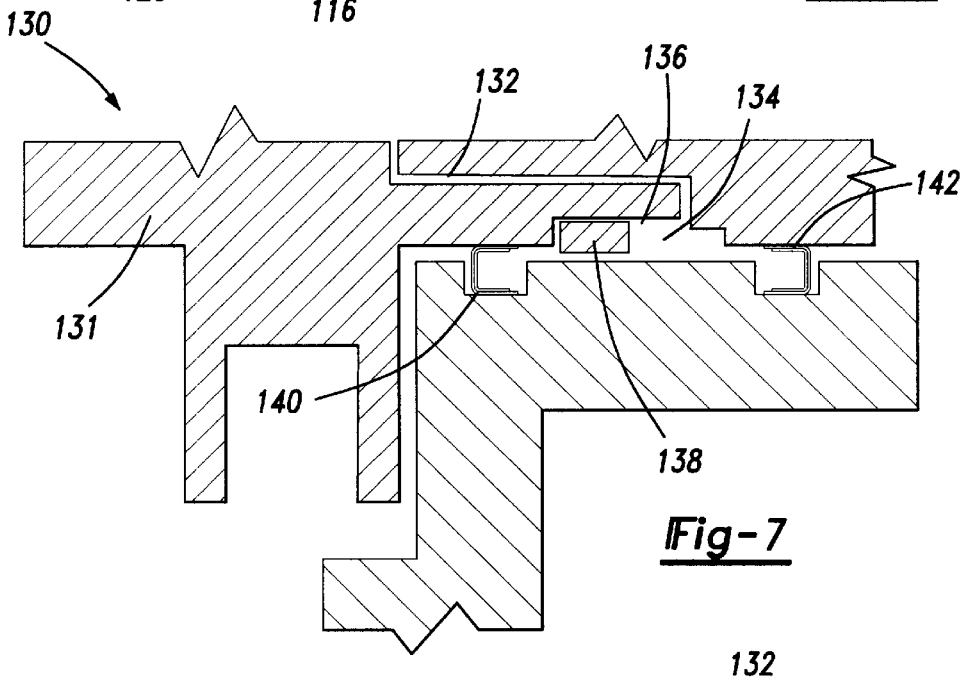
FIG. 7 is a cross-sectional view through a fifth embodiment scroll compressor.

FIG. 7 shows another embodiment 130 having an orbiting scroll 131 with a back pressure tap 132 leading to a back pressure chamber 134. Orbiting scroll 131 includes a generally C-shaped groove 136 receiving a moveable valve 138. The seals 140 and 142 are disposed on each side of the tap 132.

Figure 8:
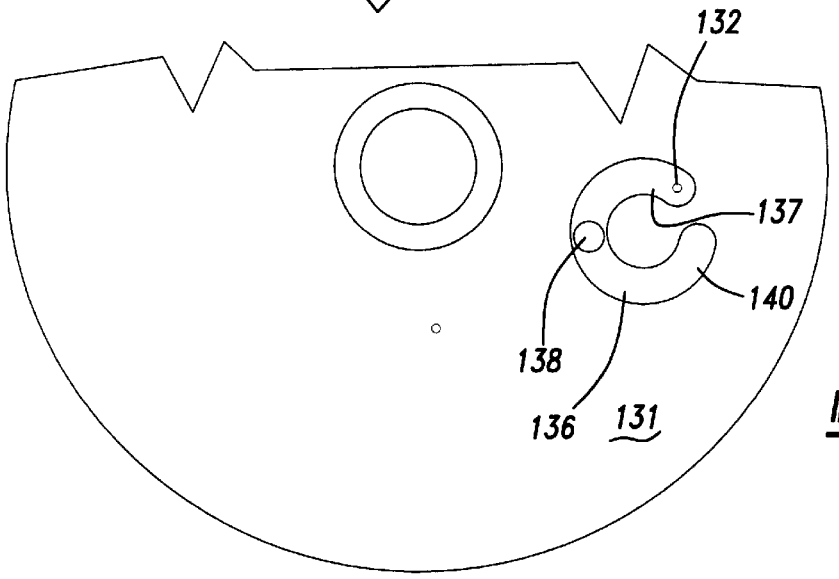
FIG. 8 is an end view of the FIG. 7 embodiment.

As shown in FIG. 8, the groove 136 includes the moveable valve 138. The tap 132 enters groove 136 at one end 137. Upon normal rotation, the valve 138 is forced by inertial and/or frictional forces towards end 140 of groove 136. Thus, the tap 132 remains open and working pressure is supplied to the back chamber 134 as desired.

However, upon reverse rotation, the valve 138 is forced towards end 137 by inertial and/or frictional forces and the back pressure tap 132 is closed. Again, in this way, the present invention ensures the seals 140 and 142 are protected since the very low pressure is not communicated to the back chamber 134 upon reverse rotation.

Other arrangements that achieve the basic function of preventing the pressure imbalance come within the scope of this invention. As examples, while two separate seals are shown, it is known to use a single seal to provide both inner and outer seals. Also the seals may be of a type other than the specifically illustrated C-shaped seals. As another example, the seals can be mounted in the orbiting scroll rather than the crankcase. The present invention can extend to all these arrangements and others that come within the scope of the invention.

Several embodiments of this invention have been disclosed, however, a worker of ordinary skill in the art would recognize that certain modifications would come within the scope of this invention. Thus, the following claims should be studied to determine the true scope and content of this invention.

We claim:

1. A scroll compressor comprising:

a first scroll member having a generally spiral wrap extending from a base;

a second scroll member having a base with a generally spiral wrap extending from said base and interfitting with said first scroll member to define movable compression chambers;

a housing supporting said second scroll member;

a back pressure tap extending through a base of one of said first and second scroll members and communicating with a back pressure chamber defined outwardly of said base of said one scroll member; and a seal system sealing said back pressure chamber at both radially inner and outer locations, and said seal system being operable to block flow of suction pressure refrigerant into said back pressure chamber when said second scroll member is orbiting in a first direction, a relief formed with said seal system for allowing flow of suction pressure refrigerant into said back chamber when said scroll is orbiting in a direction reversed from said first direction, said relief existing but not allowing suction pressure refrigerant flow when said second scroll member is orbiting in said first direction.

2. A scroll compressor as recited in claim 1, wherein said relief is formed in said housing.

3. A scroll compressor as recited in claim 1, wherein said relief is formed in said seal.

4. A scroll compressor as recited in claim 3, wherein said seal system includes a pair of seals at said radially inner and outer locations, and one of said seals includes said relief.

5. A scroll compressor comprising:

a first scroll having a generally spiral wrap extending from a base;

a second scroll having a base with a generally spiral wrap extending from said base and interfitting with said first scroll wrap to define moveable compression chambers;

a housing supporting said second scroll;

a back pressure tap extending through said second scroll and communicating with a back pressure chamber defined between said second scroll and said housing, an inner seal and an outer seal disposed in inner and outer seal grooves between said housing and said second scroll; and wherein said inner seal groove having a relief, said relief communicating suction pressure into said back chamber during reverse rotation, said inner and outer seal grooves being formed into said housing, said relief extending into said housing for a depth approximately equal to the depth of said inner seal groove, said relief being formed at an outer radial wall of said inner seal groove.

6. A scroll compressor as recited in claim 5, wherein said inner and outer seals are disposed in inner and outer seal grooves.

7. A scroll compressor as recited in claim 6, wherein at least one of said grooves has at least one relief extending from one wall of said groove such that if said seal expands against said one wall, said relief communicates suction pressure into or out of said back chamber.

8. A scroll compressor as recited in claim 7, wherein said relief is at a radially outer wall of said inner seal groove.

9. A scroll compressor as recited in claim 5, wherein a valve is exposed to back chamber pressure, and exposed to a suction pressure tap on an opposed face from said back chamber pressure, such that upon rotation in said second direction, said valve allowing suction pressure to communicate to said back pressure chamber, but upon rotation in said first direction, fluid from said at least one compression chamber communicates into said back chamber.

10. A scroll compressor as recited in claim 9, wherein said valve is generally aligned with said back pressure tap and is forced to seal against a rear face of said orbiting scroll and close said back pressure tap upon rotation in said second direction.

11. A scroll compressor as recited in claim 9, wherein said valve is forced against a valve seat to close said suction pressure tap upon rotation in said first direction, but being driven away from said suction pressure tap upon rotation in said second direction allowing suction pressure to flow into said back chamber.

12. A scroll compressor as recited in claim 11, wherein said suction pressure tap communicates with an oil reservoir such that upon reverse rotation oil is directed into said back chamber.

13. A scroll compressor as recited in claim 5, wherein a valve is associated with said back pressure tap and is moved at least during rotation in said second direction to block said back pressure tap.

14. A scroll compressor as recited in claim 13, wherein said valve has at least one magnetic face biased towards a face of said orbiting scroll to close said back pressure tap but which is driven away from said back pressure tap by fluid pressure during rotation in said first direction.

15. A scroll compressor as recited in claim 13, wherein said valve is received within a valve chamber and said valve and said valve chamber being designed such that a flow area between said valve and said back pressure tap is greater than the flow area around said valve to ensure that said valve will close said back pressure chamber upon a very low pressure being found in said compression chamber.

16. A scroll compressor as recited in claim 13, wherein said valve is moveable between at least two positions, and being moved towards a position blocking said back pressure tap upon rotation in said second direction.

17. A scroll compressor as recited in claim 16, wherein said valve is moveable within a groove, and inertial and/or frictional force forces said valve to one extreme of said groove upon rotation in a first direction and to an opposed end of said groove upon rotation in said second direction, said valve covering said back pressure tap when at said opposed end.

18. A scroll compressor as recited in claim 5, wherein said inner seal area having a relief at an outer periphery, said relief allowing suction pressure gas flow into said back pressure chamber during rotation in said second direction.

19. A scroll compressor as recited in claim 5, wherein at least said inner seal is generally C-shaped having upper and lower seal lips.

20. A scroll compressor as recited in claim 5, wherein said inner and outer seals are provided by separate seal members.

21. A scroll compressor as recited in claim 5, wherein said inner and outer seals are provided by seals mounted in said housing.

22. A scroll compressor comprising:

a first scroll having a generally spiral wrap extending from a base;

a second scroll having a base with a generally spiral wrap extending from said base and interfitting with said first scroll wrap to define moveable compression chambers;

a housing supporting said second scroll;

a back pressure tap extending through said second scroll and communicating with a back chamber defined between said second scroll and said housing, an inner seal and an outer seal disposed in inner and outer seal grooves formed in said housing; and wherein said inner seal groove having a relief, said relief communicating suction pressure into said back chamber during reverse rotation.

23. A scroll compressor as recited in claim 22, wherein said relief extends into said housing for a depth approximately equal to the depth of said groove.

24. A scroll compressor as recited in claim 22, wherein said relief is only formed at an outer wall of said inner seal groove.

25. A scroll compressor as recited in claim 22, wherein at least said inner seal is generally C-shaped and having upper and lower lips.

* * * * *